US006729874B2

(12) United States Patent
Poe et al.

(10) Patent No.: US 6,729,874 B2
(45) Date of Patent: May 4, 2004

(54) VENTURI CLUSTER, AND BURNERS AND METHODS EMPLOYING SUCH CLUSTER

(75) Inventors: Roger L. Poe, Beggs, OK (US); Wesley Ryan Bussman, Tulsa, OK (US); I-Ping Chung, Tulsa, OK (US); Ralph Robert Hayes, Collinsville, OK (US); Jaiwant D. Jayakaran, Tulsa, OK (US); Andrew Jones, Winfield, KS (US); Jason D. McAdams, Tulsa, OK (US); Demetris T. Venizelos, Claremore, OK (US); Richard T. Waibel, Broken Arrow, OK (US)

(73) Assignee: John Zink Company, LLC, Tulsa, OK (US)

( * ) Notice: Subject to any disclaimer, the term of this patent is extended or adjusted under 35 U.S.C. 154(b) by 3 days.

(21) Appl. No.: 09/874,383

(22) Filed: Jun. 4, 2001

(65) Prior Publication Data

US 2002/0015930 A1 Feb. 7, 2002

Related U.S. Application Data

(60) Provisional application No. 60/221,087, filed on Jul. 27, 2000.

(51) Int. Cl.[7] ..... F23D 14/62; F23C 6/02

(52) U.S. Cl. ..... 431/354; 431/177; 431/278; 239/418; 137/602; 137/599.03

(58) Field of Search ..... 431/354, 177, 431/174, 8, 2, 115, 116, 278; 239/400, 418, 422; 137/602, 896, 599.01, 599.03, 597

(56) References Cited

U.S. PATENT DOCUMENTS

| | | | | |
|---|---|---|---|---|
| 1,723,988 A | | 8/1929 | Arrowsmith | |
| 2,369,236 A | * | 2/1945 | Jaros | 431/179 |
| 2,618,325 A | | 11/1952 | Seitz | |
| 2,935,128 A | | 5/1960 | Ferguson | |
| 3,850,571 A | * | 11/1974 | Zink et al. | 431/349 |
| 4,257,762 A | | 3/1981 | Zink et al. | |
| 4,708,638 A | * | 11/1987 | Brazier et al. | 431/116 |
| 5,062,788 A | * | 11/1991 | Best | 431/354 |
| 5,336,284 A | * | 8/1994 | Schifftner | 96/323 |
| 5,676,173 A | * | 10/1997 | Conrad et al. | 137/896 |

FOREIGN PATENT DOCUMENTS

| | | |
|---|---|---|
| AT | 398 339 B | 11/1994 |
| CH | 110590 | 8/1925 |
| DE | G 86 33 823.4 U1 | 4/1987 |
| DE | 38 11 477 A1 | 10/1988 |
| EP | 0 209 631 A1 | 1/1987 |
| EP | 0 276 398 A2 | 8/1988 |
| EP | 0 374 423 A2 | 6/1990 |
| EP | 0 592 081 A1 | 4/1994 |
| EP | 0 809 068 A2 | 11/1997 |
| FR | 1.083.775 | 1/1955 |
| FR | 1.257.406 | 7/1961 |
| FR | 1.503.671 | 12/1967 |
| NL | 6500688 | 7/1966 |
| WO | WO 98/27386 | 6/1998 |

* cited by examiner

*Primary Examiner*—Josiah Cocks
(74) *Attorney, Agent, or Firm*—James H. Marsh, Jr.; Stinson Morrison Hecker LLC

(57) ABSTRACT

A burner arrangement includes a venturi cluster including a plurality of venturis arranged for parallel flow. The multi venturi arrangement utilizing pressurized fuel as the inducing fluid to induce a flow of air enables the provision of an ultra fuel lean premix of fuel and air. A central burner tube which extends outwardly beyond the delivery end of a primary burner tip and mounts a relatively small capacity nozzle at a substantial distance from the delivery end of the burner tip enabling the ultra fuel lean mixture to expand and slow down such that its linear speed does not exceed the flame speed of the mixture prior to by the flame of the spaced nozzle. A deflector may be positioned adjacent the nozzle to assist in stabilizing the flame after the expansion and slowing process has been completed.

34 Claims, 8 Drawing Sheets

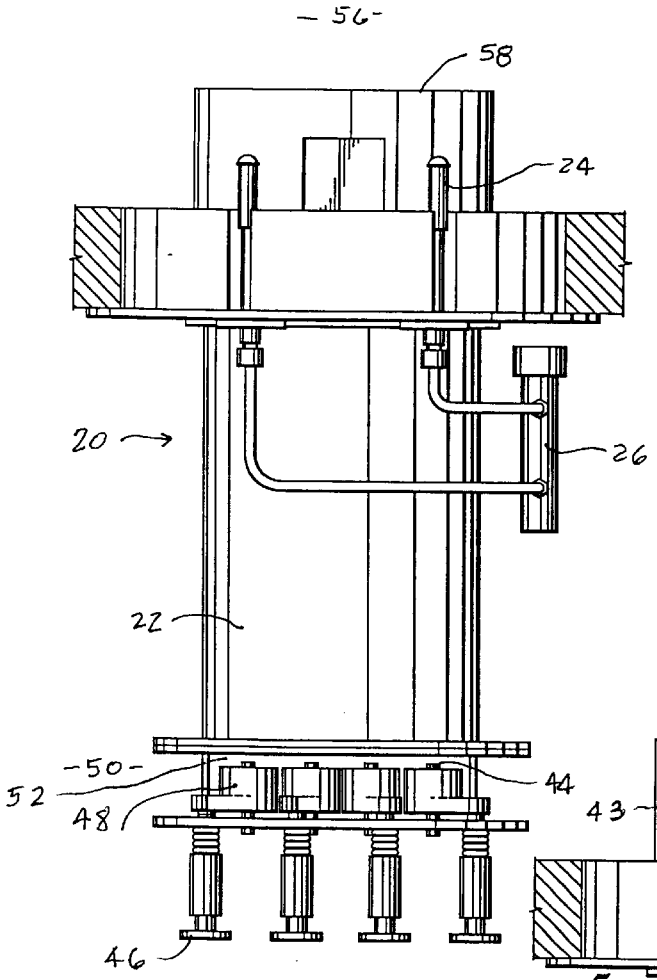
FIG. 1.
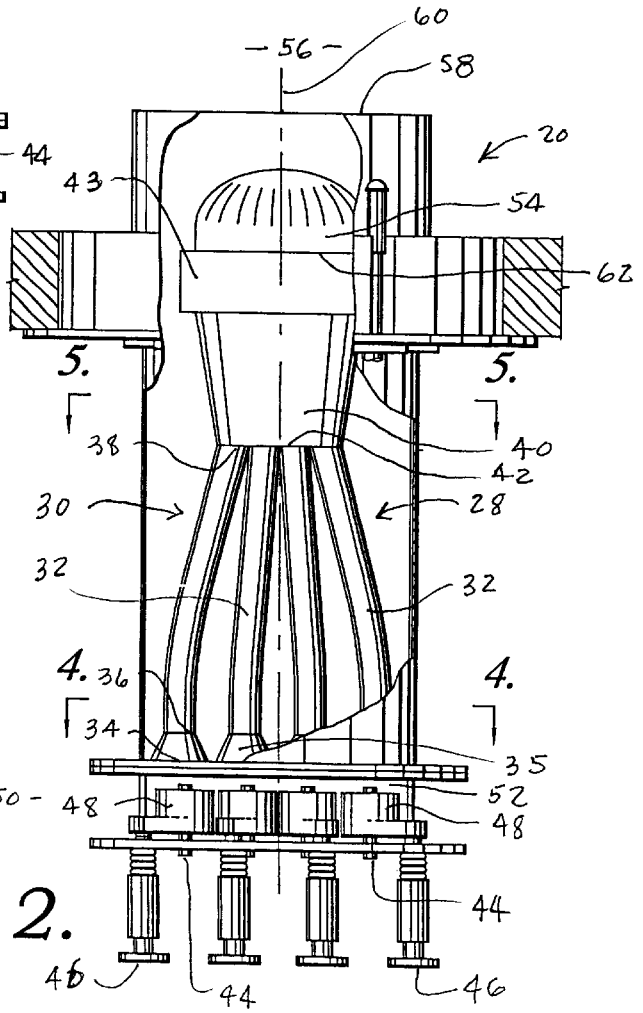
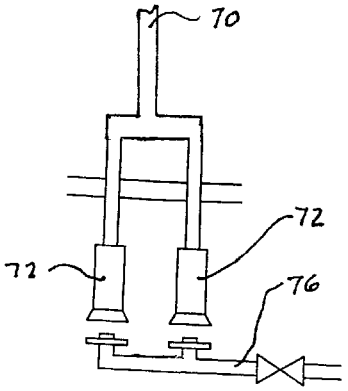
FIG. 11A
FIG. 2.

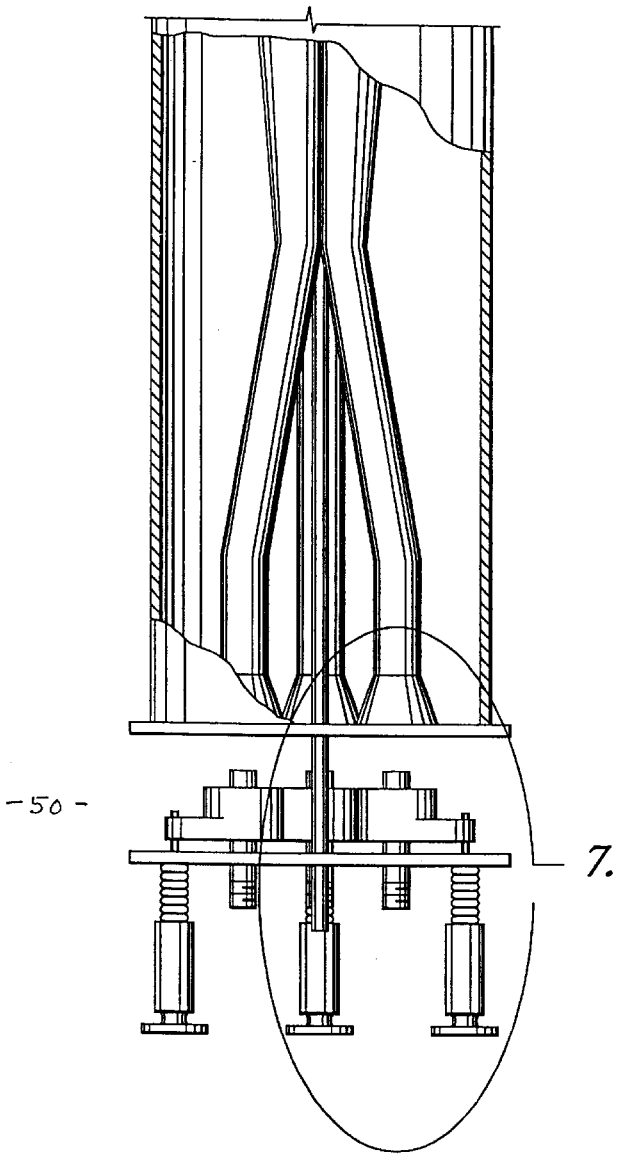
FIG. 6.
FIG. 15.
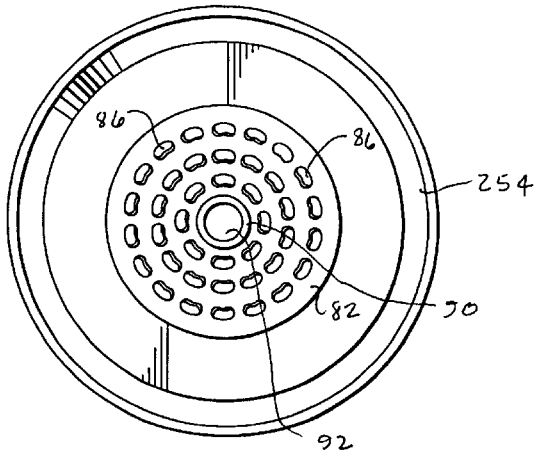
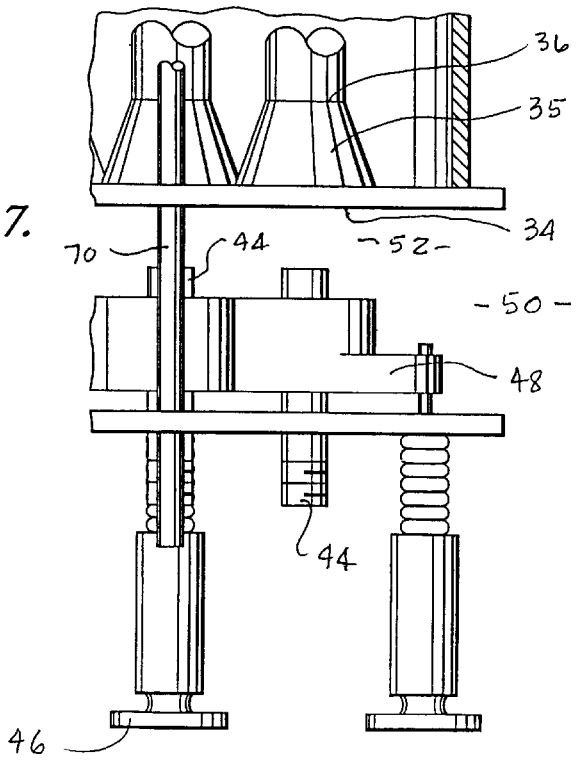
FIG. 7.

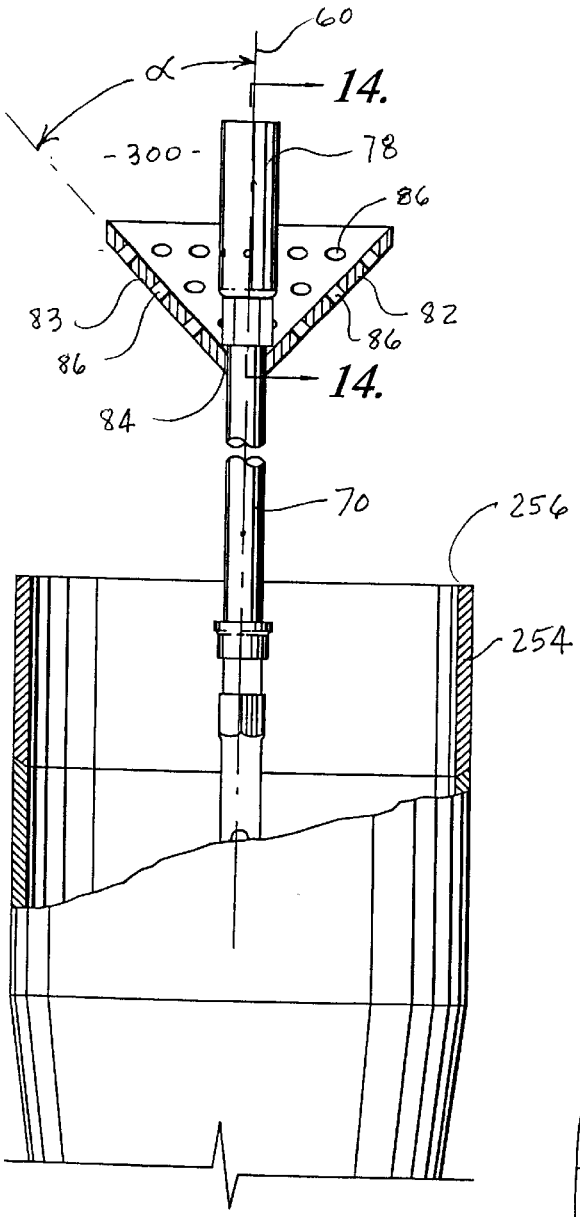
FIG. 13.
FIG. 14.
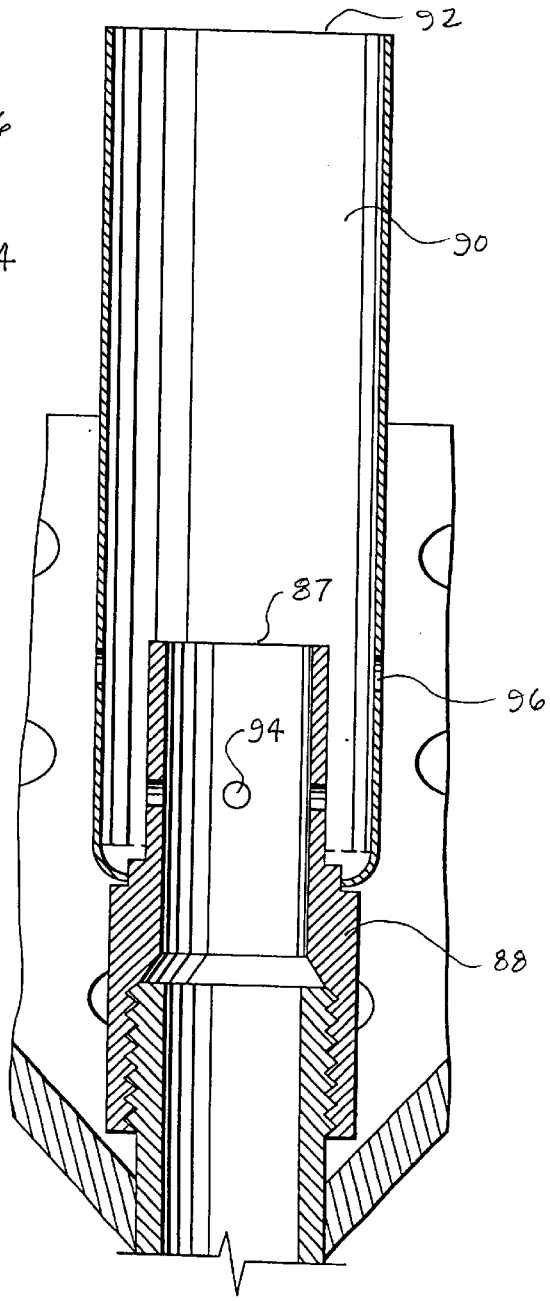

VENTURI CLUSTER, AND BURNERS AND METHODS EMPLOYING SUCH CLUSTER

REFERENCE TO RELATED APPLICATION

Priority is claimed in the present application pursuant to 35 U.S.C. § 119(e) from provisional application Ser. No. 60/221,087, filed Jul. 27, 2000, the entirety of the disclosure of which is hereby specifically incorporated herein by this specific reference thereto.

BACKGROUND OF THE INVENTION

1. Field of the Invention

The present invention relates to venturis which induce the flow of a fluid when an inducing flow of another fluid is passed therethrough. The invention further relates to industrial burners, and in particular to burners which utilize venturis to induce the flow of one or more of the components of a combustible mixture and thereby create such mixture for introduction into a combustion zone. The invention also relates to burner devices capable of creating and handling oxygen rich combustible mixtures.

2. The State of the Prior Art

Venturi devices for inducing the flow of one fluid (the induced fluid) by flow of another fluid (the inducing fluid) are known. These devices generally consist of a tube which has an inlet end, a throat area and an outlet end. Generally speaking, the throat has a smaller flow area than the inlet end whereby to provide a low pressure area at the throat. The inducing fluid flows through the tube from the inlet end of the venturi to the outlet end, and a source of the induced fluid is in fluid communication with the low pressure area created in the throat of the device by the flow of the inducing fluid. Thus, the induced fluid is drawn into the throat and mixes with the inducing fluid.

Venturi devices are particularly useful in burners where a flow of fluid fuel is used to induce a flow of air to thereby create a mixture of the fuel and the air in the venturi. Sometimes, however, it is useful to use the combustion air to induce a flow of the fuel. Alternatively, a flow of air or fuel through the venturi may be used to induce a flow of recirculated flue gas or other diluent to control flame temperature and thus influence $NO_x$ production.

In spite of their wide spread use, venturis still have certain limitations. In the first place, the capacity of the venturi for inducing a flow of induced fluid is limited by the available pressure of the inducing fluid and the quantity of the latter needed for a given application. In addition, the length of an efficient venturi typically is directly related to the diameter of the throat. The physical dimensions of the work environment thus may have a limiting influence on the capacity of the venturi.

In a more general sense, the reduction and/or abatement of $NO_x$ in industrial burners has always been a desirable aim. Some $NO_x$ abatement has been achieved in the past by using a fuel lean primary combustible fuel/air mixture coupled with staging of a portion of the gaseous fuel. Fuel lean primary mixtures are potentially desirable in some applications because the excess air provides a load to reduce flame temperatures whereby to reduce $NO_x$. Staged gas may then be introduced into the combustion zone either from gas tips arranged around the periphery of the burner or from a center gas tip which protrudes through the center of the downstream end of the burner nozzle. The secondary fuel is combusted with the excess air in an environment where flue gases are available as a diluent. These arrangements have not always been successful in reducing $NO_x$ to desirable levels.

In some instances, a fuel lean primary mixture is introduced into the combustion zone at a relatively high velocity due to the extra mass provided by the excess air. Such velocity may sometimes be so high that the flame speed is exceeded providing an unstable flame environment.

SUMMARY OF THE INVENTION

In accordance with the principles and concepts of the invention, the same provides, in one important aspect, a compound venturi structure which includes a venturi cluster made up of a plurality of venturis. Thus, by definition, in accordance with this aspect of the invention, the compound venturi structure has at least two venturis. Desirably, the structure may have at least three, often will have at least six, and in some instances, depending upon the exigencies of a particular application, may have even more than six venturis. An important purpose of the present invention is to provide practical solutions for problems that are extant in the burner field today, in particular those that involve the production of excessive $NO_x$ levels. Thus, the invention provides structure and methodology directed to addressing and alleviating the problems which have been mentioned above. Moreover, the invention solves problems that relate to venturis generally. Because of the increased surface area provided by the multiplicity of venturis, a given volume of the inducing fluid may educe a greater flow of the induced material. Moreover, for a given flow of inducing fluid, the throats of the venturis in a bundle have smaller throats and therefore may be smaller in length.

Each of the venturis of the cluster may have an inlet, a throat and an outlet, and each may be arranged and adapted for causing the flow of an induced material by passage of an inducing fluid therethrough. This action creates, in each venturi, a respective mixture of induced material and inducing fluid, which mixture may then be discharged from the outlets of the respective venturis. The structure also may desirably include a collector having an inlet end which is connected to and arranged in fluid communication with the outlets of the venturis. Thus, the respective mixtures of inducing fluid and induced material discharged from the outlets may be collected and intermixed to present a single mixed stream for discharge from an outlet end of the collector. The induced material most often may be a fluid material; however, in accordance with the broader aspects and contemplations of the invention, the induced material may be a solid flowable material, such as, for example, a powder or a flake material.

The venturis of the compound venturi structure of the invention may desirably, but not necessarily, be in the form of elongated, essentially straight tubes. Preferably, but not necessarily, the tubes may be arranged in essential parallelism relative to one another. The venturis may also have essentially the same physical capacity; however, this also is not a necessary or critical feature of the invention, and in fact, there are many applications where it may be desirable for at least one of the venturis of a given cluster to have a different physical capacity than another of the venturis of that same cluster.

In another important aspect of the invention, the compound venturi structure may be a component of a novel burner assembly. In accordance with this aspect of the invention, in addition to the venturi cluster and the collector, the burner assembly may include a burner tip that is attached to and in fluid communication with an outlet end of the collector. Thus, the tip may be arranged for receiving the single mixed stream of fluids from the collector and directing the same into a combustion zone.

In one important embodiment of the invention, the tip may be elongated and adapted and arranged for directing the single mixed stream out of the tip and into the combustion zone in a generally radial direction relative to a longitudinal axis of the tip. Such a tip may desirably be configured so as to create a round flat flame which surrounds the tip.

In another important embodiment of the invention, the tip may be elongated and adapted and arranged for directing the single mixed stream out of tip and into the combustion zone in a generally axial direction relative to a longitudinal axis of the tip. This tip may desirably be configured so as to create a cylindrical flame which extends along the axis.

In a general sense, either a gaseous fuel or air may be the inducing fluid; however, desirably, at least one of the venturis may be adapted and arranged for operation with a gaseous fuel as the inducing fluid. When a gaseous fuel is used as the inducing fluid, either air or recirculated flue gas may be the induced fluid. Desirably, at least one of the venturis may be adapted and arranged to operate with air as the induced fluid. Thus, when a gaseous fuel is used as the inducing fluid and air is the induced fluid, the single mixed stream created in the collector may comprise a mixture of fluid fuel and air. Similarly, when a gaseous fuel is used as the inducing fluid and recirculated flue gas is the induced fluid, the single mixed stream may comprise a mixture of fluid fuel and flue gas. For some applications, a gaseous fuel may be used as the inducing fluid to induce a flow of air in one venturi of a given cluster and to induce a flow of flue gas in another venturi of the cluster. The single mixed stream may thus comprise a mixture of fluid fuel, air and recirculated flue gas. One or more of the venturis of the cluster may be adapted and arranged to operate with a diluent as the induced fluid, whereby the single mixed stream comprises a fluid fuel and a diluent. The diluent may be steam or nitrogen or $CO_2$ or some other available gas which is inert relative to the combustion reaction process.

In accordance with an important aspect of the invention, the collector may preferably be elongated and arranged so as to include a central axis which extends between the ends thereof. Desirably, the assembly may also include a central fuel tube that extends through the collector along the axis of the latter. Ideally, the central fuel tube may also extend through the burner tip and the same may have a downstream end portion which projects through a centrally located opening at a downstream end of the burner tip. In accordance with a preferred aspect of the invention, the assembly may include a fuel nozzle located at the downstream end portion of the central fuel tube.

Ideally, the inlet end of the collector may include a respective open segment for each of the venturis of the cluster, and the outlets of the venturis may each be connected to a respective segment. The segments may be arranged in a series extending around the central fuel tube so that the mixed streams are evenly distributed around the interior of the collector. If the tip is adapted and arranged for directing the single mixed stream out of the tip and into the combustion zone in a generally radial direction relative to a longitudinal axis of the tip, the fuel nozzle may desirably be adapted and arranged for providing secondary fuel to the combustion zone. On the other hand, if the tip is adapted and arranged for directing the single mixed stream out of the tip and into the combustion zone in a generally axial direction relative to a longitudinal axis of the tip, the fuel nozzle may desirably be adapted and arranged to provide a continuous primary flame at a location in the zone which is spaced axially from the downstream end of the tip. Ideally, in the latter case, the fuel nozzle may be located at a position where it is spaced far enough from the downstream end of the tip in the combustion zone such that the single mixed stream has been allowed to expand and slow to a speed such that its velocity, when it comes into proximity with the fuel nozzle, is no greater than the flame sustaining velocity.

In another aspect, the invention provides a burner assembly that comprises a burner tube structure which may, but does not necessarily, include one or more venturi tubes. The burner tube structure does, however, include an elongated burner conduit having spaced inlet and outlet ends. Such conduit may be a venturi tube. Alternatively it may simply be a hollow tube or pipe. The conduit may generally be adapted and arranged for directing a combustible gaseous mixture comprising a fluid fuel, preferably in the form of a gaseous fuel, and oxygen, preferably in the form of air, therealong from the inlet end thereof to the outlet end. In accordance with this aspect of the invention, a burner tip may be provided at the outlet end of the conduit, and such burner tip may desirably have a central axis and a downstream end spaced from the outlet end of the conduit. The tip may generally be arranged and adapted for receiving the combustible mixture from the conduit and directing the same through one or more apertures at the downstream end of the tip and into a combustion zone in a direction generally along the axis of the tip.

The assembly of this aspect of the invention may further include an elongated central fuel tube that extends through the tip and along the axis. This fuel tube desirably may project out of the tip in an axial direction through the downstream end of the latter, and the fuel tube may have a downstream end portion that is located in the combustion zone in spaced relationship relative to the downstream end of the burner tip. The aperture or apertures at the downstream end of the tip may be disposed around the fuel tube, whereby the mixture directed into the combustion zone may generally be in the form of a cylinder which surrounds the fuel tube and extends outwardly of the downstream end of the tip along the axis toward the downstream end portion of the fuel tube. Ideally, the assembly includes a fuel nozzle on the downstream end portion of the fuel tube which is located at a position in the zone that is sufficiently remote from the downstream end of the burner tip so as to permit the mixture to expand after it has left the downstream end of the tip and slow to a velocity which is less than the flame velocity thereof before it comes into proximity with the fuel nozzle. In this form of the invention, the burner assembly may desirably be used in situations where the combustible mixture comprises an ultra fuel lean mixture of fuel and air.

In further accordance with the concepts and principles of the invention, a generally dome shaped burner tip is provided. The novel burner tip of the invention desirably includes a generally ring shaped base portion having a central axis and a plurality of elongated, side-by-side, circumferentially spaced, longitudinally curved ribs which extend in a direction along the axis. The ribs may each have a first end that is mounted on the base and a second end that is spaced from the base, with the second ends being located nearer the axis than the first ends. The base portion and the ribs together define an area inside the tip adapted for receiving a flow of a mixture of air and fluid fuel, and the ribs alone define a multiplicity of curved slots therebetween permitting the mixture to flow from the area inside the tip and outwardly into a combustion zone outside the burner tip in both a radial direction and in a direction which includes a vector extending along the axis. In accordance with the invention, the burner tip may comprise a crown portion connected to the second ends of the ribs, and such crown portion may include a plurality of axially and radially extending discontinuities which are aligned with respective slots such that the air/fluid fuel mixture flowing through the discontinuities has a more pronounced axial flow direction relative to the air/fluid fuel mixture flowing through the slots. These discontinuities may desirably be positioned so as to cause the air/fluid fuel mixture flowing therethrough to create a prestaged mixing area outside the combustion zone. The crown portion may also have an axially aligned, gas nozzle accommodating opening therein.

In one preferred embodiment of the invention, the tip described in the foregoing paragraph may be used in conjunction with a burner assembly that comprises a compound venturi structure as described above.

The invention also provides a method for increasing the capacity of a venturi device to induce the flow of a second fluid into a first fluid when a flow of the first fluid passes through the device. The method comprises separating the first fluid into at least two, desirably at least three, perhaps at least six or more separate flow portions, passing each separate flow portion of the first fluid through a respective venturi to independently induce a flow of the second fluid into each of the flow portions thereby creating respective separate mixtures of the first and second fluids, and admixing the respective separate mixtures to thereby create an admixture of the first and second fluids containing a greater concentration of the second fluid than would be possible by passing the entire amount of the first fluid through a single venturi. In accordance with the invention, the first fluid may desirably be a gaseous fuel and the second fluid may desirably be air.

The invention further provides a method for decreasing the length of a venturi device adapted for inducing the flow of a second fluid into a first fluid when a flow of the first fluid is passed through the device. In this form of the invention, the method comprises separating the first fluid into at least two, preferably at least three, and perhaps at least six or more separate flow portions; passing each separate flow portion of the first fluid through a respective venturi to independently induce a flow of the second fluid into each of the flow portions of the first fluid, thereby creating respective separate mixtures of the first and second fluids; and admixing the respective separate mixtures to thereby create an admixture of the first and second fluids containing a greater concentration of the second fluid than would be possible by passing the entire amount of the first fluid through a single venturi of the same length.

Furthermore, the invention provides a method for operating a venturi device that comprises providing at least two venturis, each venturi having an inlet, a throat and an outlet, and each being operable for inducing the flow of an induced material when an inducing fluid is passed therethrough, whereby to produce a respective mixture of the induced material and the inducing fluid and discharging the mixture from the outlet thereof; passing a first inducing fluid through a first of the venturis to thereby induce the flow of a first induced material and produce a first mixture comprising the first inducing fluid and the first induced material, and discharging the first mixture from the outlet of the first venturi; passing a second inducing fluid through a second of the venturis to thereby induce the flow of a second induced material and produce a second mixture comprising the second inducing fluid and the second induced material, and discharging the second mixture from the outlet of the second venturi; and collecting and intermixing the first and second mixtures to present a single mixed stream of the fluids and materials.

Additionally the invention provides a method for operating a burner equipped with a venturi device for supplying a combustible mixture to a burner nozzle which comprises providing at least two venturis, each venturi having an inlet, a throat and an outlet, and each being operable for inducing the flow of an induced fluid when an inducing fluid is passed therethrough, whereby to produce a respective mixture of the induced and inducing fluids that is discharged from the outlet thereof; passing a first inducing fluid through a first of the venturis to thereby induce the flow of a first induced fluid and produce a first mixture comprising the first inducing fluid and the first induced fluid, and discharging the first mixture from the outlet of the first venturi; passing a second inducing fluid through a second of the venturis to thereby induce the flow of a second induced fluid and produce a second mixture comprising the second inducing fluid and the second induced fluid, and discharging the second mixture from the outlet of the second venturi; and collecting and intermixing the first and second mixtures to present a single combustible mixed stream of the fluids. Ideally, the first and second inducing fluids may each be gaseous fuels and the first and second induced fluids may each be air. Alternatively, the first induced fluid may be air and the second induced fluid may be a recirculated flue gas or other diluent such as steam or nitrogen or $CO_2$ or any other inert gas.

BRIEF DESCRIPTION OF THE DRAWINGS

FIG. 1 is an elevational view of a burner assembly which includes a compound multiventuri cluster that embodies the concepts and principles of the invention;

FIG. 2 is a view, similar to FIG. 1, except that the assembly is shown partly in cross-section to reveal the interior components;

FIG. 6 is an elevational view, partly in cross-section, illustrating a portion of an alternative compound multiventuri cluster that embodies the concepts and principles of the invention;

FIG. 7 is an enlarged detail view illustrating the encircled portion 7 of the compound venturi cluster of FIG. 6;

FIG. 11A is a partial view showing an alternative arrangement for the burner assembly of FIG. 11;

FIG. 13 is an elevational view, partly in cross-section illustrating the downstream portion of yet another burner assembly which embodies the concepts and principles of the invention;

FIG. 14 is an enlarged cross-sectional view illustrating the details of the burner assembly portion of FIG. 13;

FIG. 15 is a top plan view of the burner assembly of FIG. 13; and

DETAILED DESCRIPTION OF PREFERRED EMBODIMENTS OF THE INVENTION

The present invention provides a number of novel features which are useful either in combination or alone. In particular these features are useful in connection with burners and/or burner assemblies adapted to burn fluid fuels. These fluid fuels may be fuel oil or the like, but preferably may be a gaseous fuel such as natural gas, propane, butane or hydrogen, or the like.

Figure 5:
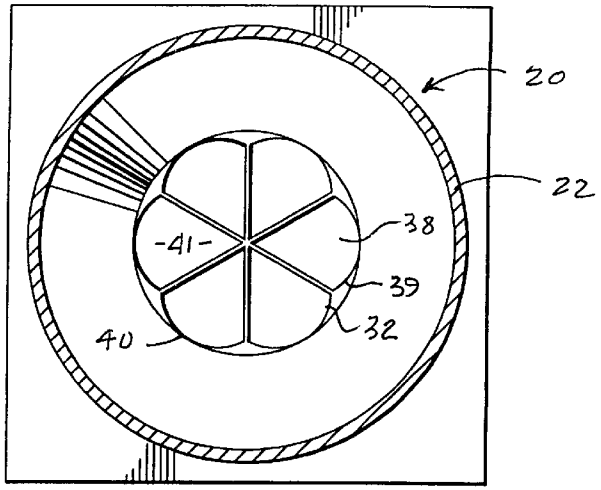
FIG. 5 is a cross-sectional view taken essentially along the line 5—5 of FIG. 2.
Figure 4:
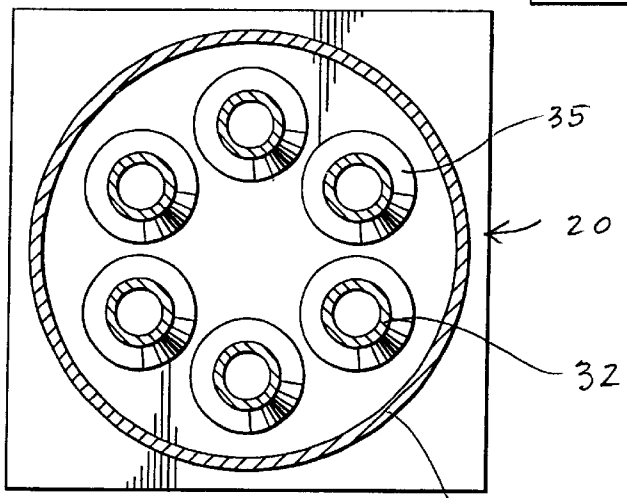
FIG. 4 is a cross-sectional view taken essentially along the line 4—4 of FIG. 2.
Figure 3:
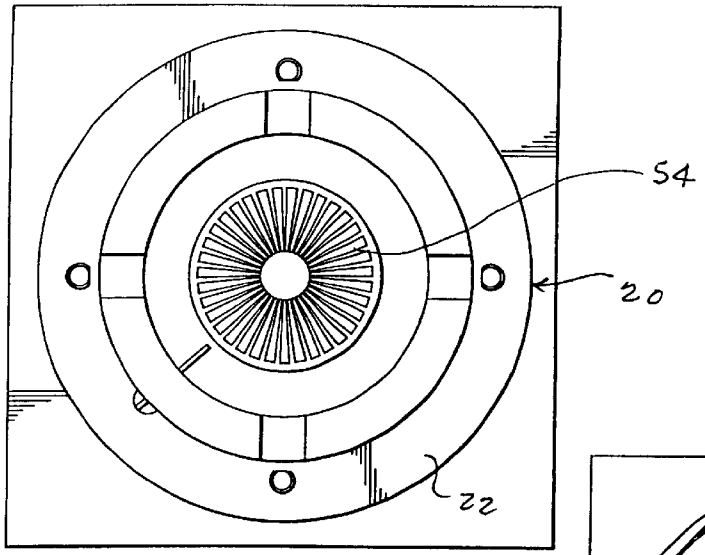
FIG. 3 is a top plan view of the burner assembly of FIG. 1.

One burner assembly which embodies principles and concepts of the invention is illustrated in FIGS. 1 through 5, where it is identified by the reference numeral 20. The burner assembly 20 includes an outer, generally cylindrical shell 22 and a series of peripherally mounted secondary fuel nozzles 24 that are connected to a fuel manifold 26. As can be seen in FIGS. 2, 4 and 5, the assembly 20 further includes a compound venturi structure 28 which, as shown, includes a venturi cluster 30 made up of six separate and discrete venturis 32. Each of the venturis 32 has an inlet 34 at the lower or upstream end thereof (as the same are depicted in FIG. 2), a throat 36, and an outlet 38 at its upper or downstream end. As can be seen in FIGS. 2, 4, 6 and 7, the inlet end portions 35 of the venturis, which extend from the inlets 34 to the throats 36, are outwardly flared and essentially cone or bell shaped.

Individually, the venturis 32 may be conventional venturi type structures of the sort that are well known to the routineers in the burner art, and the same may each be adapted and arranged so as to cause the flow of an induced material simply by passing an inducing fluid therethrough. By this phenomenon, a respective mixture of induced material and the inducing fluid is created in the venturi and discharged through the outlet 38 at the downstream end of the venturi.

The structure 28 also includes a collector 40 having an inlet end 42 that, as shown in FIG. 2, is connected to and arranged in fluid communication with the outlets 38 of the venturis 32. As will be appreciated by those skilled in the art, the upper ends 39 of the venturis 32 adjacent the outlets 38 thereof may have an appropriate shape, as shown schematically in FIG. 5, so as to provide a smooth transition zone 41 where the outlets 38 join the inlet end 42 of the collector 40. By virtue of such an arrangement, the respective mixtures leaving the outlets 38 at the downstream ends of the venturis are collected and intermixed in the collector 40 to thereby form a single mixed stream. To facilitate the intermixing operation, the collector 40 may be provided with a radially expanded portion 43 as shown.

Although the venturi cluster is depicted in FIGS. 2, 4 and 5 as including six separate venturis, it will be apparent to those skilled in the art that the cluster may just as well include as few as two venturis arranged for parallel flow. Conversely, the cluster may include even more than six venturis, for example twelve or more venturis, depending upon the needs of a given application.

As would be apparent to those of ordinary skill in the art, the inducing fluids for the venturis may be different. Also, the induced materials do not need to be all the same. For example, in the case of a burner, the inducing fluid may be a fuel such as a gaseous fossil fuel or hydrogen, while the induced material may be a fluid such as, for example, air, or a combustion-inert diluent, such as, for example, recirculated flue gas, steam, $CO_2$ or nitrogen. Alternatively, the inducing fluid may be air while the induced material may be a fluid fuel or a diluent. In any case, the respective mixtures produced in the individual venturis 32 will become intimately intermixed in the collector 40 so as to produce a single mixed stream which, when the venturi cluster 30 is used in a burner, may contain an oxidant, a fluid fuel, and an appropriate diluent.

For purposes of using the concepts and principles of the present invention in connection with burners, the inducing fluid may desirably be a fluid, preferably a gaseous fuel, and the induced material may desirably be an oxygen containing gas, preferably air. To this end, the burner assembly 20 may be provided with a series of fuel gas inlet tubes 44 that may be connected to a common source of fuel which is not shown in the drawings. The burner assembly 20 may also be provided with a series of control handles 46, desirably one handle 46 for each venturi 32. These handles 46 are each operable for moving a respective control element 48 in a conventional manner, toward and away from the inlet 34 of a corresponding venturi 32, to thereby control the amount of air which may be drawn into the corresponding venturi 32 from a surrounding air box as a result of pressurized fuel gas flowing into the inlet 34 via inlet tube 44. The air box is indicated generally by the reference numeral 50 in FIG. 1.

With the arrangement described above, when fuel gas is discharged into a respective venturi through a corresponding tube 44, air from air box 50 is drawn into inlet 34 through the gap 52 between each inlet 34 and the corresponding element 48. The amount of air drawn into inlet 34 may be controlled by varying the width of the gap 52 by raising and/or lowering the element 48 using the corresponding handle 46. This air, which is drawn into inlet 34 as a result of the fuel gas flowing into inlet 34 via tube 44, joins with the fuel gas discharged from tube 44 to thereby create a mixture of fuel gas and air that flows through the venturi 32 and is discharged from the venturi 32 via outlet 38.

The details of the air controls are particularly well illustrated in FIGS. 6 and 7, where the same are shown as components of a three venturi burner arrangement. It is to be noted in this latter regard, that the venturis 32, the tubes 44, the handles 46 and the control elements 48 of FIGS. 6 and 7 are essentially the same as the corresponding components of the assembly 20 of FIGS. 1 and 2. Thus, as the handles 46 are turned in on direction, the gap 52 is widened, and when turned in an opposite direction, the gap 52 is narrowed. The arrangement of FIGS. 6 and 7 also includes a central fuel supply pipe 70 which serves purposes discussed hereinbelow.

The individual respective mixtures from the venturis 32 are collected and intermixed in collector 40 to present a single mixed stream of fuel gas and air which may then be directed into a burner tip 54 for distribution into a combustion zone 56 that generally surrounds the upper end 58 of the burner arrangement 20. As can be seen in FIG. 2, the collector 40 may preferably be elongated in a direction along the central longitudinal axis 60 of the burner assembly 20, and the same may have a outlet or downstream end 62 upon which the burner tip 54 may be positioned.

The venturis 32 may preferably be arranged for parallel flow in the cluster 30, and the respective mixtures produced in the venturis are fed into a common collector 40 where the same are joined together to present a single combustible premix comprising air and fuel. This premix is then directed into the common premix tip 54 which is mounted at the downstream end 62 of the collector. The premix tip 54 may be designed in such a way that the pressure inside the tip is essentially the same as the pressure which would normally be present if only a single venturi were employed. This insures a pressure drop associated with the velocity of the gas which is consistent with that associated with a single venturi. The use of the multiple venturis allows for the use of multiple gas spuds (injectors) which in turn diffuse air into the simple gas jet at the same rate. The added surface area of three singular jets (or more depending on the particular needs of a given application) allows for appreciable increases of air to be diffused into the jet. This also allows more air to be entrained into the opening of the venturi by the momentum of the jets because the entrainment rate of the induced fluid varies directly with the surface area of the inducing stream. The additional air entrained is a function of the number of gas jets employed as well as the momentum of the gas once it leaves the spud (injector).

In one of the embodiments of the invention, as described above in relationship to FIGS. 1, 2 and 3, the venturi cluster 30 may include six of the venturis 32. In other, equally valuable forms of the invention, the cluster 30 may include two or more, three or more, or even more than six venturis. For example, a burner assembly employing three venturis is illustrated in FIGS. 6 and 7. The only limitation in this regard is that the venturis of each cluster discharge into a common collector 40 where the individual mixtures from the respective venturis may be mixed together to form a single mixed stream. In the embodiment described above, the inducing fluid is described as being a fuel gas and the induced fluid is described as being air.

In a preferred form of the invention, the respective capacities of the individual venturis may be the same. In accordance with the broad contemplation of the invention, however, the individual venturis of a given cluster need not be identical. That is to say, the capacity of one or more of the venturis of a given cluster may be different than the capacity of one or more other venturis of the same cluster. Moreover, the inducing fluid of one or more of the venturis of a given cluster may be different than the inducing fluid of one or more other venturis of the same cluster. In addition, the induced fluid of one or more of the venturis of a given cluster may be different than the induced fluid of one or more other venturis of the same cluster. Just as an example in this regard, the induced fluid of one venturi of a given cluster may be air, while the induced fluid of another venturi of the same cluster may be flue gas or a diluent such as nitrogen or steam. Furthermore, and as another example for a burner, the inducing fluid could be air and the induced fluid could be a fuel gas. As would be readily appreciated by those of ordinary skill in the burner art, there are a great number of possible combinations of venturi capacities, inducing fluid and induced fluid which might be usefully employed in a single venturi cluster in accordance with the concepts and principles of the invention.

The number of venturis to be used at any given time for any given application is determined by the heat release of the burner as well as the geometry of the burner which is desired for the application. In ultra low $NO_x$ applications, one or more venturis may be utilized to pull flue gases from the furnace, while the remaining venturis may be utilized for gas and air. The furnace flue gases may then be commingled with the fuel and air mixture from the other venturis in the collector 40, thus adding mass to the overall combustion stream. The additional loading of the flame caused by the additional mass, along with the deceleration of reaction kinetics, will lower the flame temperature thus lowering the $NO_x$ emissions. This concept, along with the use of a homogenous premixed mixture of gas and air as the primary fuel element in other burner designs, can well lead to the reduction in $NO_x$ emissions in other types of burners as well provide a broad range of heat releases.

The use of a multiplicity of venturis to supply a premix of fuel and air facilitates the provision of an ultra fuel lean premix. Such ultra fuel lean premix may desirably contain only about 55% or so of the total fuel required, and perhaps even less, while often containing all of the oxygen required to combust the total fuel. The remainder of the fuel may then be supplied as secondary fuel via staged nozzles. This concept of ultra lean premix, which keeps the gas to air ratio just above the lower combustion limits, provides for maximum loading on the heat generated by the primary flame. The multiple venturi arrangement facilitates the ultra lean premix concept while maximizing the capability of staging a rich raw gas stream as staged gas. The diffuse premix gas stream coupled with flue gas entrained by the staged gas jets has opened up new opportunities for $NO_x$ reduction. $NO_x$ emissions performance in this design of burner, has been observed to be as low as 3 ppm by vol.

As stated before, the surface area of multiple jets that are separated and contained in independent converging bell shaped inlets 35, is illustrated in FIGS. 2, 4, 5 and 6, is much more efficient in entraining air. This is due to the additional jet surface area and decrease in diameter created by separating one large jet into several small jets. The size of the jet is decreased as a function of the diameter of the port and the divergence of the jet in the ambient fluid. The angle of divergence, which is largely a function of the design of the gas port, also is determinative of the surface area of the jet. Each jet created using separate gas ports and multiple venturis, when supplied at the same fuel pressure, will entrain and diffuse air at the same rate. This rate of diffusion/entrainment will increase the burner's capability of delivering a very fuel lean or ultra lean premix. Although not desired, the composition of the premix from the multiventuri cluster can be adjusted to the point where the mixture is below flammability limits. By keeping the premix composition just within the flammability limits of the fuel being fired, it is possible maximize the mass of air that will then maximize the thermal load on the flame. The additional thermal load will decrease the flame temperature and thus reduce thermal $NO_x$ formation.

Figure 11:
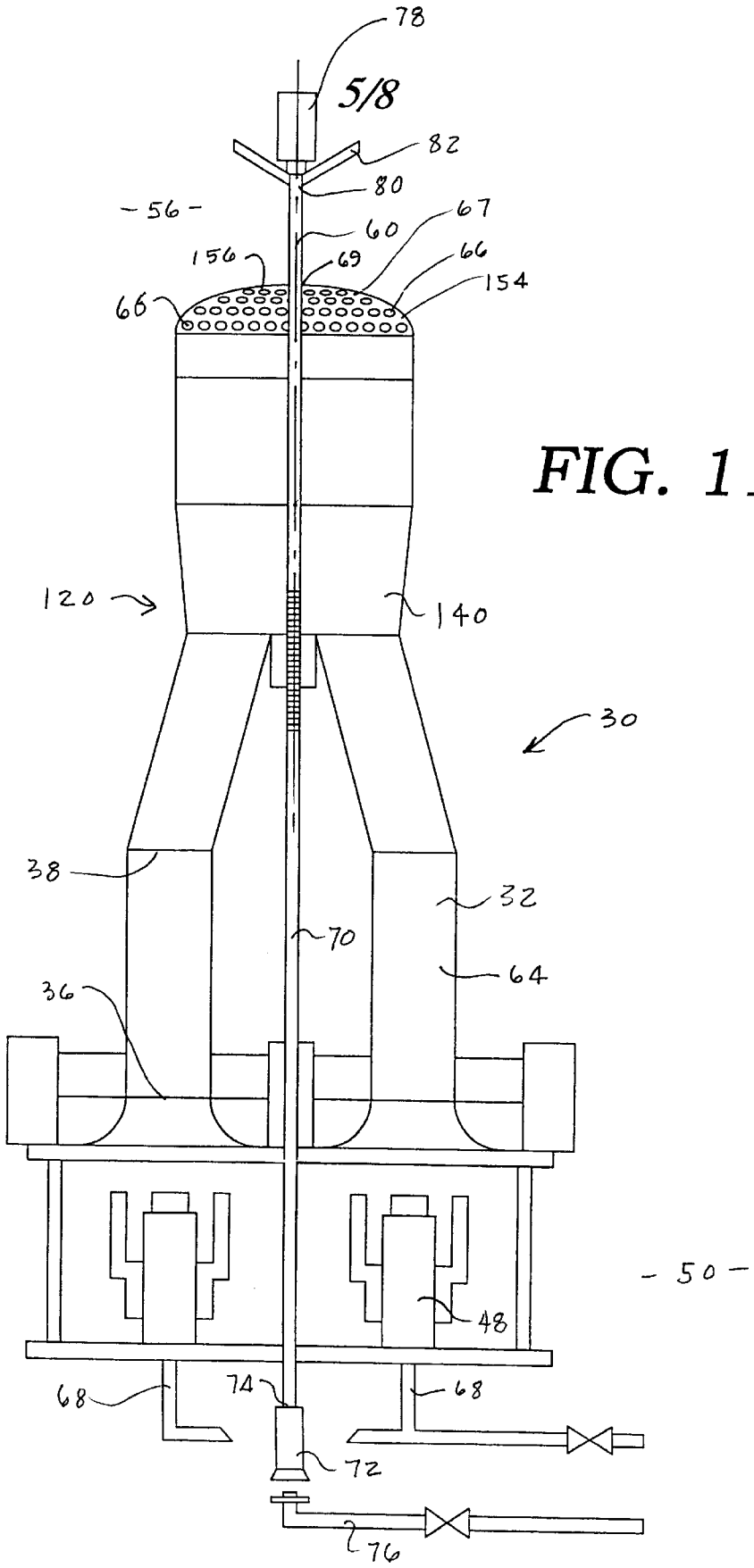
FIG. 11 is a schematic view of another embodiment of a burner assembly which embodies the concepts and principles of the invention.

Another embodiment of a burner assembly which embodies the principles and concepts of the invention is illustrated schematically in FIG. 11 where it is identified by the reference numeral 120. In FIG. 11, components which are essentially the same as components identified in connection with FIGS. 1 through 5 are given like reference numerals. In FIG. 11, the venturi cluster 30 is shown as having only two venturis 32; however, as explained above, the cluster 30 of FIG. 11 could just as well have three or four or more venturis, with the only limitation being available space. The venturis 32, as shown in FIG. 11, each include an elongated, essentially straight tube 64 which extends between the throat 36 and the outlet 38. And as can be seen, the tubes 64 are arranged in essential parallelism relative to one another. In particular the tubes 64 are arranged for parallel flow of fluids. It should be noted in this latter regard, however, that the arrangement shown in FIG. 11 is not essential for the performance of the cluster 30. Rather, as will be recognized by those skilled in the art, it is not a necessity that the downstream portions 64 of the venturi be straight or that the same be positioned in parallelism relative to one another.

Figure 10:
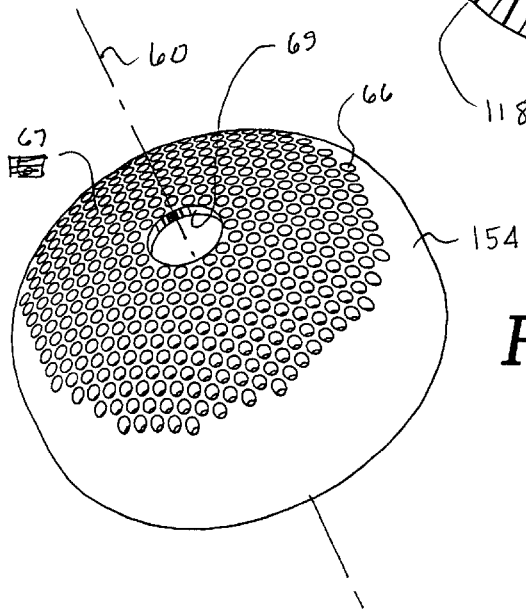
FIG. 10 is a perspective view of an alternative embodiment of a burner tip which embodies the concepts and principles of the invention and which may be used in conjunction with a compound venturi cluster of the invention to present a burner assembly.

The burner tip 154 of the burner assembly of FIG. 11, which is illustrated in greater detail in FIG. 10, is preferably elongated in a direction along the axis 60 and the same is adapted and arranged for directing the single mixed stream of fuel and air received from collector 40 outwardly into zone 56 in a direction along axis 60. To this end, the tip 154 may be provided with a plurality of openings 66 in the downstream end 67 thereof, which openings 66 are positioned to direct the mixed stream of fuel and air along the axis 60 as can best be seen in FIG. 11.

The venturis 32, as shown in FIG. 11, are each provided with a supply of fuel gas via an inlet pipe or spud 68, and the air flow may be controlled in the same manner as described above using moveable control elements 48 (handles 46 not shown in FIG. 11). Thus, in the FIG. 11 embodiment, fuel gas may be the inducing fluid and air is the induced fluid. The assembly 120 of FIG. 11, may also be provided with an elongated central primary fuel tube 70 which extends along the central axis 60 of assembly 120 as shown and protrudes through a hole 69 in the downstream end 67 of tip 154. A small venturi 72 is provided at the upstream end 74 of tube 70, and a supply of primary fuel for tube 70 is provided via an inlet fuel spud or pipe 76. Thus, a primary mixture of air and fuel is caused to flow along tube 70 toward a primary nozzle 78 located atop a downstream end portion 80 of tube 70 that is located in combustion zone 56. It should be noted here, that in accordance with the invention, while the material supplied to the nozzle 78 may desirably be an air/fuel premix, it is also possible that raw fuel may be supplied to the nozzle 78 for stabilization purposes.

As can be seen from FIG. 11, the openings 66 are disposed in surrounding relationship relative to tube 70. Thus, as the combustible mixture of fuel and air is expelled from the tip 154 through the openings 66, the same is in the form of a cylinder which extends toward nozzle 78 in surrounding relationship to tube 70. Upon ignition of the combustible mixture, a generally cylindrical flame, which extends along axis 60, is created.

A flame holder 82, for a purpose discussed hereinafter, is mounted on tube 70 just beneath nozzle 78. The details of certain preferred embodiments of the flame holder 82 and the nozzle 78 are shown in FIGS. 13 and 14. However, it is to be noted that the burner tip 254 illustrated in FIG. 13 differs from the burner tip 154 of FIG. 11, in that the latter has a plurality of the openings 66 in the end wall 156 thereof, whereas the burner tip 254 simply has a cylindrical shape which is essentially wide open at its downstream end 256.

With reference to FIG. 13, the flame holder 82 may desirably have a conical shape with the apex 84 thereof pointed away from the nozzle 78. Desirably, the apex 84 may be located approximately 8 inches above the upper end 256 of tip 254. In a particularly preferred form of the invention, the flame holder 82 may have an outer diameter of about 4" when the tube 70 is formed from a 1" diameter pipe, and the same may be formed from a shaped plate attached to the tube 70 by tack welds or set screws or the like. The enclosed angle a between the axis 60 and the skirt 83 of the cone of the flame holder 82 may desirably be 45°.

In its most preferred form, the holder 82 may have a plurality of ¼" holes 86 therein distributed in a pattern which surrounds tube 70. These holes 86 may ideally be of sufficient size and number such that approximately 30 percent of the surface area of the holder 82 is open area. It should be noted in this regard, however, that in accordance with the principles and concepts of the invention, the open area may range from less than about 10% to more than about 75% of the surface area of the holder 82. For that matter, in accordance with the invention, the holder may be of a variety of different diameters depending upon the diameter of the main burner opening into the furnace. The diameter of the holder 82 may thus vary from one-fourth of the diameter of the main burner opening into the furnace to the same diameter as the main burner opening into the furnace. Further, the angle $\alpha$ may range from about 30° or less to about 80° or more. It should also be noted in connection with the foregoing, that the shape of the holder 82 is not critical, and almost any shape may be used so long as the same is capable of deflecting the combustible mixture leaving the tip 154, 254 and create a low pressure 300 downstream of the flame holder 82 which serves to pull the combustible mixture into a stagnant, low velocity zone where ignition may be stabilized and maintained.

The nozzle 78 may desirably be in the form illustrated in FIG. 14 where it is shown as comprising a base 88 made up of a drilled and machined piece of hexagonal bar stock and a cylindrically shaped upper cup portion 90 having an open upper end 92. The base 88 may be provided with holes 94 and the cup portion 90 may be provided with holes 96, which holes 94, 96 may be sized and positioned as necessary to achieve the results desired for the nozzle 78 in providing the desired primary flame. The cup portion 90 protects the flame from being blown off of the open end 87 of the base 88 by ambient gas currents. In the absence of such currents, the cup portion 90 may not be needed.

The arrangement illustrated schematically in FIGS. 11, 13 and 14 provides extremely good NOx performance. As explained above, the multi-venturi concept enables the provision of an ultra fuel lean premix which itself leads to substantial $NO_x$ reduction. When the multi-venturi concept is coupled with the arrangement of FIGS. 11, 13 and 14, even lower $NO_x$ may be achieved as a result of the low velocity zone stabilization of the ultra-lean premix.

With reference again to FIG. 11, it is often preferred that only a small portion, perhaps no more than about 10%, and desirably 2% or less, of the total fuel is introduced via spud 76 and used to educe air from air box 50. The fuel and air are premixed in tube 70 coming up through the center of the burner. As mentioned above, in some cases it may be desirable to supply a raw fuel via tube 70. Tube 70 passes through the primary premix gas tip 154 and terminates in the shielded nozzle 78 located some distance above the primary or main premix tip 154. This distance may vary from less than about 3 inches to 15 inches or more, depending upon the speed and pressure of the premix as it leaves tip 154 and the size of the burner. Thus a small primary flame is established in the elevated nozzle 78 at a position above the upper end 156 of the main premix tip 154. The cone shaped flame holder 82, fabricated from perforated plate, is located just under the elevated nozzle 78 to provide a location for the main premix mixture from tip 154 to be drawn into the primary stabilizing flame created adjacent nozzle 78. Thus the cone 82 and the primary nozzle 78 provide a mechanism for maintaining a stable flame in the ultra fuel lean premix supplied from tip 154. Once a stable flame has been established, the primary flame generated at the exit end 92 of nozzle 78 may be extinguished to provide even greater $NO_x$ reduction.

Locating the primary flame in the manner described above at a substantial distance from the exit of the main burner tip 154 provides an opportunity for the main air/fuel mixture to expand and slow down after exiting the main tip 154. This slowing down of the premix to a speed no greater than the flame speed is desirable for stabilizing the ultra fuel lean premix flame. A significant problem occurring when an ultra fuel lean combustible mixture is used, is that flame speed varies directly with the fuel content. Thus, the flame speed is very low in an ultra fuel lean mixture. Mixture temperature may also affect flame speed with higher temperatures resulting in higher flame speeds and vice versa. That is to say, when the combustible mixture is ultra fuel lean, whereby it contains a very large excess of air, the velocity of the flow coming out of the main burner tip may exceed the flame speed, a condition which results in blowing of the flame off of the burner tip.

By delaying ignition until after the main fuel air mixture has exited from the tip and has expanded into the furnace space, has slowed down in velocity, and has been incrementally heated by radiation from the hot surroundings, a situation is created where the flame speed once again exceeds the flow velocity and the flame is therefore easily maintained in a stable condition in the stabilizing zone provided by the elevated nozzle 78 and holder 82. The ignition and combustion of the main gas in a low velocity zone stabilization manner, at a substantial distance from the main premix tip outlet, produces previously unobtainable $NO_x$ reduction performance, approaching 5 ppm on natural gas and even less than 3 ppm on a refinery blend fuel gas (e.g., 25% hydrogen, 25% propane, 50% methane). In addition to the foregoing, the already dilute fuel lean premix entrains furnace flue products after it exits the main tip and while it is expanding and slowing and thereby becomes even more diluted before ignition. This also contributes to the greater NOx reduction.

In accordance with the arrangement illustrated in FIG. 11, it may be possible to run the center venturi 72 quite lean but within stable flammability limits, and drive the surrounding multi-venturi/common collector 140 to very very lean mixtures which may even be below the flammability limit and will have to depend on the furnace temperature to complete the oxidation of the fuel.

Figure 16:
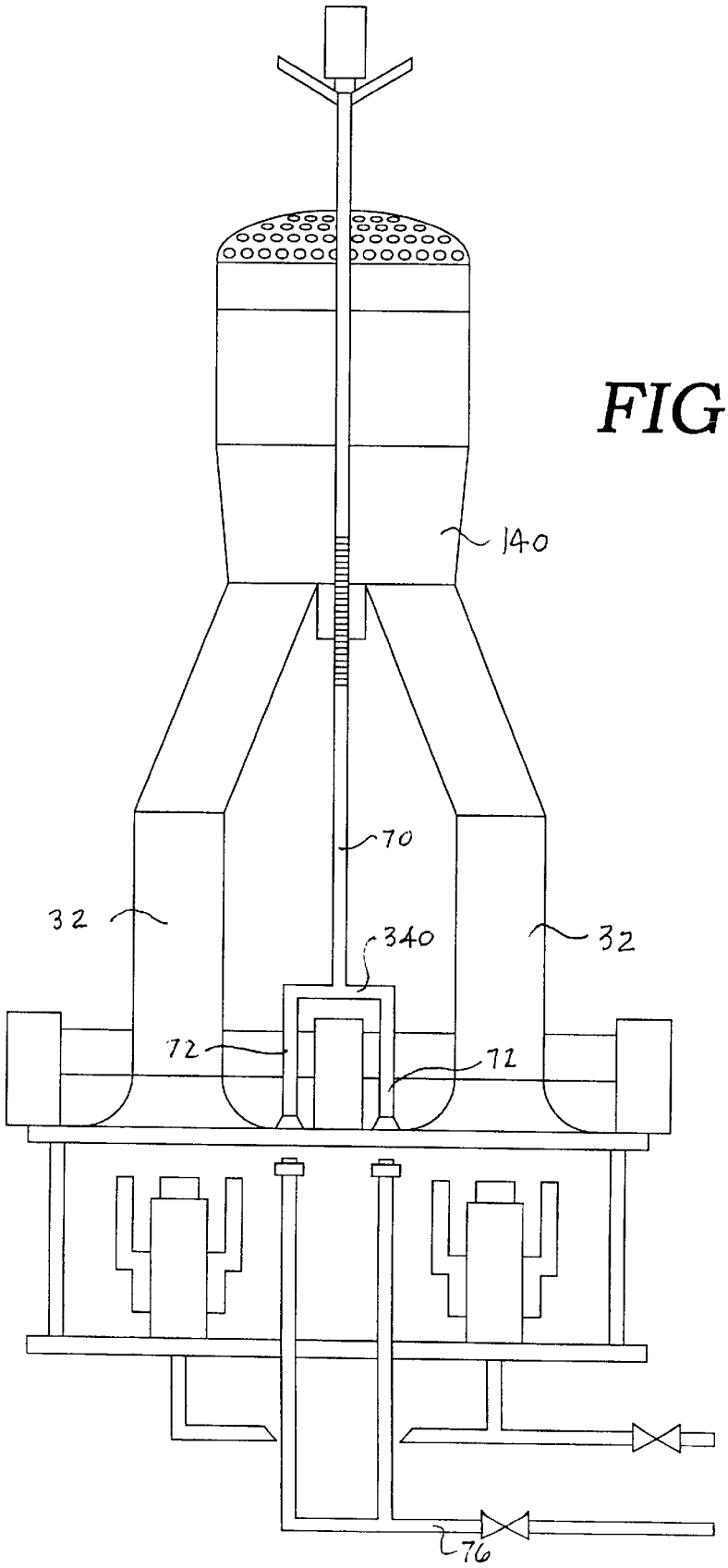
FIG. 16 is a schematic view of a burner assembly similar to the burner assembly of of FIGS. 11 and 11A except that the center venturi bundle is surrounded by the peripheral venturi bundle.

In accordance with another aspect of the invention, the fuel/air mixture in tube 70 may be supplied by an cluster arrangement which includes a plurality of venturis 32. This arrangement is illustrated schematically in FIG. 11A. In this case, the overall assembly desirably includes two separate venturi clusters, an outer one which supplies an air/fuel premix to the burner tip 154 and an inner one supplying an air/fuel premix to tube 70. Another alternative arrangement where the inner multiventuri bundle is completely surrounded by the outer venturi bundle is illustrated schematically in FIG. 16. As shown in FIG. 16, the outer venturi bundle includes the venturis 32 and the common collector 140, while the inner venturi bundle includes the venturis 72 and the common collector 340. In these cases where the arrangement includes an inner multiventuri bundle positioned within an outer multiventuri bundle, the inner cluster may be operated within stable flammability limits and the outer cluster may be operated so as to provide an extremely fuel lean air/fuel premix so as to maximize the conditions needed for $NO_x$ reduction. It is contemplated that this sort of an arrangement will facilitate the construction of very large burners having as many as six or more venturis in the inner bundle and as many as twelve or more venturis in the outer bundle.

Figure 12:
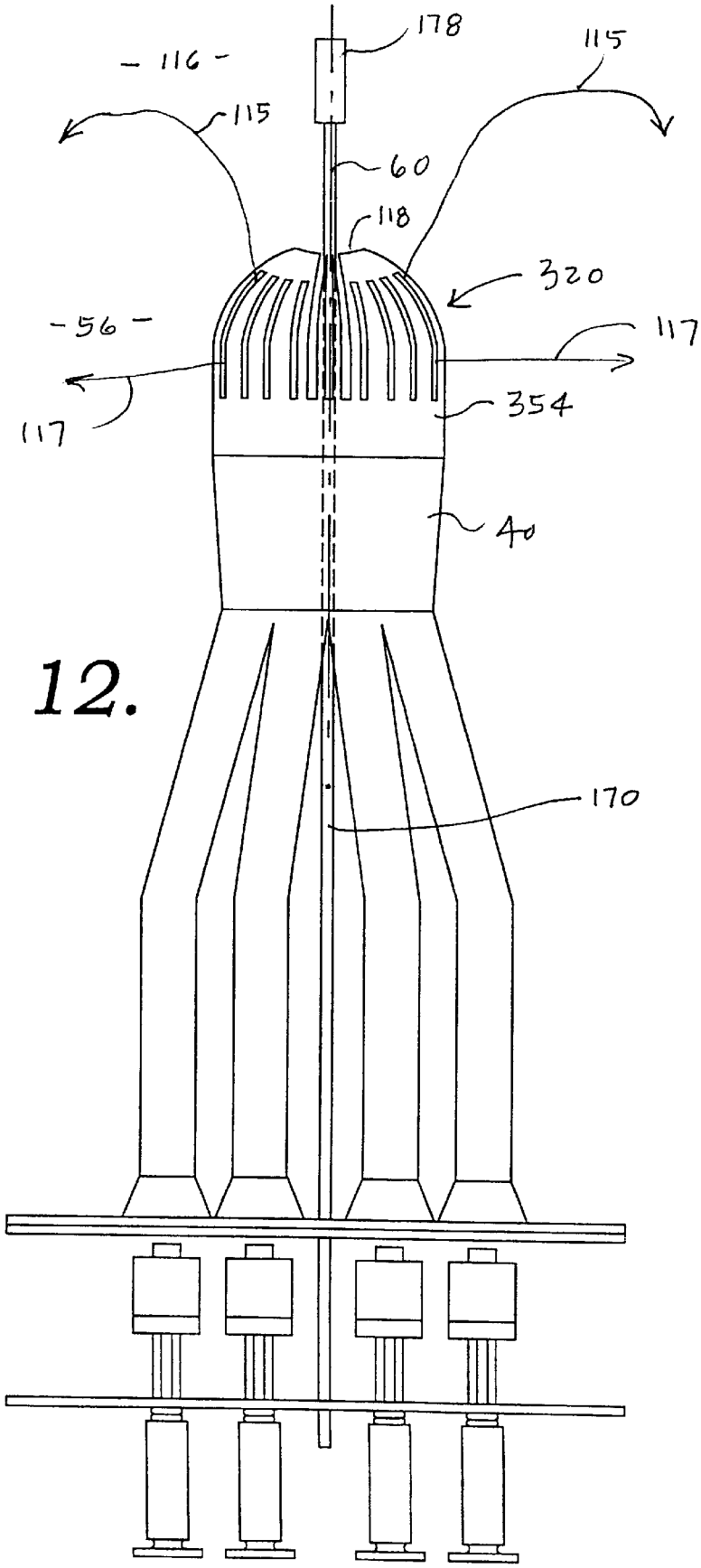
FIG. 12 is a schematic view of yet another embodiment of a burner assembly which embodies the concepts and principles of the invention.

With reference now to FIG. 12, it can be seen that the principles and concepts of the invention apply also to radiant burners where the premix is directed radially from the tip 354. In this regard reference is made to co-pending, co-assigned U.S. application Ser. No. 09/803,808, filed Mar. 12, 2001, the entirety of the disclosure of which is hereby incorporated herein by specific reference thereto. Thus, the burner assembly 320 shown schematically in FIG. 12 includes the burner tip 354, which is elongated in a direction which extends axially through the burner assembly, and the same is adapted and arranged for directing the single mixed stream received from the collector 40 into the combustion zone 56 in a generally radial direction relative to the axis 60. Thus, the burner tip 354 is adapted and arranged to create a round flat flame which surrounds the tip 354. With further reference to FIG. 12, the assembly 320 may also include a central tube 170 to supply secondary fuel to the combustion zone via a nozzle 178

Figure 8:
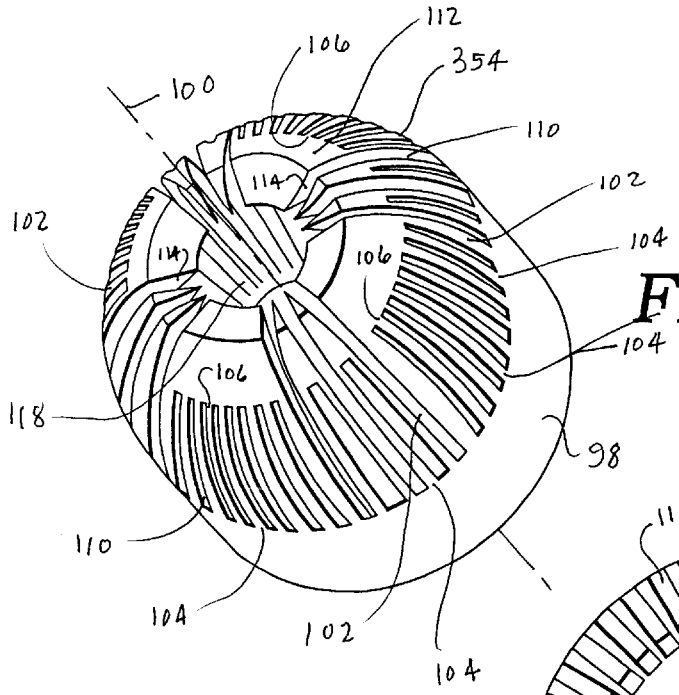
FIG. 8 is a perspective view of an embodiment of a burner tip which embodies the concepts and principles of the invention and which may be used in conjunction with a compound venturi cluster of the invention to present a burner assembly.
Figure 9:
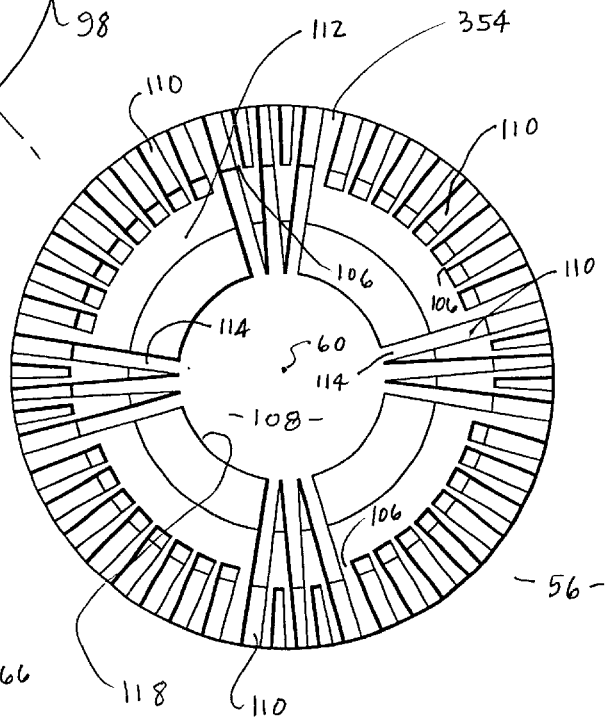
FIG. 9 is a top plan view of the burner tip of FIG. 8.

In a particularly preferred form of the invention, the burner tip 354 may be in the configuration illustrated in FIGS. 8 and 9, where it can be seen that the tip 354 has a generally ring shaped base portion 98 and a central axis 100. Furthermore, the tip 354 has a plurality of elongated, side-by-side, circumferentially spaced, longitudinally curved ribs 102. The ribs 102 have respective first ends 104 that are mounted on the base portion 98, and respective second ends 106 that are spaced from the base portion 98. As can be seen, the second ends 106 are located nearer the axis 60 than the first ends 104. The ribs 102 and the base portion 98 define an area 108 inside of the tip 354 that is adapted for receiving a flow of the single mixture of fuel and air from the collector 40. The ribs 102 define a multiplicity of curved slots 110 therebetween. As can be seen from FIGS. 8 and 9, these slots 110 are arranged and positioned such that the mixture in area 108 is permitted to flow from the area 108 and outwardly into the combustion zone 56 outside the tip 354 in both a radial direction and in a direction which includes a vector extending along axis 60.

In the preferred form thereof illustrated in FIGS. 8 and 9, the tip 354 may also include a crown portion 112 that is connected to the respective second ends 106 of the tip 354. Desirably, the crown portion 112 may include a plurality of axially and radially extending discontinuities 114 which are aligned with certain of the slots 110 such that the mixture leaving area 108 through the discontinuities 114 has a more pronounced axial flow direction than the mixture leaving area 108 through the slots 110 themselves. Ideally, the discontinuities 114 may be positioned to cause the axially directed mixture flowing therethrough to create a prestaged mixing area 116 (see FIG. 12) that is outside the combustion zone 56 where the mixture of fuel and air flowing through the discontinuities 114 may circle around in area 116 in a direction indicated by the arrows 115 so as to become diluted with flue gas before returning to the combustion zone to be combusted. In comparison, the direction of flow of the premix flowing from slots 110 is schematically illustrated by the arrows 117. In a particularly preferred form of the invention, the crown portion 112 of the tip 354 may be provided with an axially aligned, central gas nozzle accommodating opening 118.

In one aspect, the invention provides a radiant wall burner which includes a compound venturi cluster and is therefor capable of achieving high heat releases with 100% premix. This has not been possible prior to the present invention. In the past, the highest heat releases attainable were around 1.7 MMBTU/h with secondary air. However, it is to be noted that secondary air typically causes higher $NO_x$ than when all of the air is supplied as an air/fuel premix in the venturi section. This barrier has now been broken with the new design disclosed herein which includes a compound venturi cluster consisting of a plurality of venturis arranged in a single cluster for parallel fluid flow.

The invention provides low $NO_x$ with staged fuel, low noise in some configurations, staged gas jets entraining the flue gas external to the burner, prompt $NO_x$ alleviation, simplicity of operation with no secondary air adjustments, short flame profile, high turndown ratios with added premix tip velocities, high stability, minimal CO emissions, cooler premix tip (with added mass flow and greater heat transfer), and minimal flashback problems with added tip velocity.

The invention relates to a multiventuri design which, among other things, may provide excess air for ultra fuel lean mixtures for premix applications. In particular the invention may be useful either in connection with radiant wall burners or with burners which provide an axial flame. The invention is also useful in connection with large process heater burners with the primary combustible mixture made up of 100% or partial premix as a $NO_x$ reducing mechanism. But it is also to be noted that the multiventuri design of the invention has general applicability and can be extrapolated for general use whenever venturis are needed. In particular the multiventuri design of the invention operates to entrain more air than previously thought possible through increased mass transfer and diffusion. Moreover, the multiventuri design of the invention has beneficial application in typical tank and vessel venting, air handling, solids transportation and handling and anywhere where a short venturi may be needed to move large masses of materials.

In the past, radiant wall burners were not capable of reaching heat releases in excess of 1.5 MMBtu/h without the use of some other air source. With the use of multiple venturis in parallel, heat releases well in excess of 10 MMBtu/h are attainable with the correct geometry and attention to detail making sure interaction between venturis is minimized.

In one configuration, in accordance with the invention, it is possible to apply the invention to modular burners where venturi eductors may be added to increase capacity or reduce $NO_x$. In this concept, a burner may be installed with multiple venturis and may be upgraded at a later date with additional venturis to increase capacity or add steam or flue gas or other inert gases to reduce $NO_x$. In another configuration the invention is not limited to using just flue gas as a diluent to reduce $NO_x$ but can be used with any other diluent that adds mass to quench the flame. Such diluents may range from any inert gas such as nitrogen or steam or $CO_2$ to low BTU fuels like refinery PSA gas or other fuel laden vapor or gas streams with any percentage of combustible gas therein.

In other configurations, the present invention can be applied to many different designs of process heater burners that may be mounted on the floor or roof of the furnace instead of the sidewall. These may create flames that are free standing and round or flat or otherwise. They may function in furnaces that do not require the wall to be heated by the flame.

In yet other configurations, instead of fuel being used as the motive fluid in one or more of the eductors, steam or other compressed diluent gases as characterized above may be used as the motive fluid.

Typical radiant wall burners use the motive force of a single gas spud to entrain air from the atmosphere. This new concept of utilizing multiple venturis or eductors in parallel adds a new dimension to the combustion industry. The strong points of the present invention, when applied to burner technology, are as follows:

(1) Shorter flame due to better homogeneity of gas and air;
(2) Large turndown ratios are possible (10:1 as opposed to 3:1 for prior art devices);
(3) Lower noise around the burner;
(4) Tiles are not subjected to hot spots created by burning jets piercing to the tile;
(5) With 100% premix no secondary register is required;
(6) Burner operation is very stable;
(7) Burner is capable of running substoichiometric without flashback;
(8) Ability to lower both prompt and thermal $NO_x$ with flue gas injection and mixing;
(9) Staging of fuel is easily accomplished with single internal or multiple radial tips;
(10) Flashback with volatile fuels is minimized with higher tip velocities; and
(11) Much larger heat releases are achieved than previously thought possible.

In accordance with the concepts and principles of the invention, a burner which includes the novel compound venturi cluster that is the subject of the foregoing disclosure may be designed for firing upwardly, downwardly or horizontally. Moreover, the multiventuri burner of the invention may be used for burning combustible liquids such as fuel oil. Accordingly, with minimal difficulty and with minimal physical changes, the burner may be applied to combination firing arrangements. It should also be noted that the burner of the invention is readily adaptable to a variety of shapes. For example, the burner could be configured as a rectangular or other desired shape, in place of the round flame design described above.

It is also clear from the foregoing description that the invention contemplates the use of a venturi cluster in combination with a central fuel tube providing either a fuel/air premix to a central primary flame nozzle or a pure fuel to a central nozzle supplying secondary fuel to a combustion zone.

It is also clear that the invention principles and concepts of the invention may be applied so as to provide a large burner arrangement which may include an inner multi-venturi cluster located within an outer multi-venturi cluster.

The present invention provide s a number of novel features which are useful either in combination or alone in connection with burners and/or burner assemblies adapted to burn fluid fuels. These fluid fuels may be fuel oil or the like, but preferably may be a gaseous fuel such as natural gas, propane, butane or hydrogen, or the like.

We claim:

1. A compound venturi structure comprising:

a venturi cluster including at least two venturis, each said venturi having a main, elongated venturi body portion defining a conduit, a venturi inlet and a venturi outlet, each said venturi being arranged and adapted for inducing the flow of an induced material by passing an inducing fluid therethrough, whereby respective mixtures of induced materials and inducing fluids are discharged from said outlets;

an elongated collector adapted and arranged for receiving the respective mixtures of inducing fluids and induced materials discharged from said venturis, and collecting and intermixing said mixtures to present a single mixed stream of said fluids and materials, said collector having an outer peripheral wall defining an internal mixing chamber, an inlet end, an outlet end and a central longitudinally extending axis extending between said ends, said main, elongated venturi body portions being disposed in substantial parallelism relative to said central axis; and a respective elongated tubular segment for each venturi, said tubular segments being adapted and arranged to interconnect and intercommunicate the inlet end of the collector with said venturi outlets, each said tubular segment having an inlet connected to the outlet of a corresponding venturi and an outlet connected to the inlet end of the collector, and each segment being disposed to extend outwardly away from the inlet end of the collector at an angle relative to said central axis so that the inlet of the tubular segment as well as the inlet of the corresponding venturi are positioned at locations which are spaced radially from said central axis a greater distance than the distance from the axis to the place where the outlet of the tubular segment is connected to the collector.

2. A compound venturi structure as set forth in claim 1, wherein said cluster includes at least three of said venturis.

3. A compound venturi structure as set forth in claim 2, wherein said cluster includes at least six of said venturis.

4. A compound venturi structure as set forth in claim 1, wherein the inlet end of each venturi is bell shaped.

5. A compound venturi structure as set forth in claim 2, wherein the inlet end of each venturi is bell shaped.

6. A compound venturi structure as set forth in claim 3, wherein the inlet end of each venturi is bell shaped.

7. A compound venturi structure as set forth in claim 1, wherein said venturis have essentially the same physical capacity.

8. A compound venturi structure as set forth in claim 1, wherein at least one of said venturis has a different physical capacity than another of said venturis.

9. A compound venturi structure as set forth in claim 2, wherein said venturis have essentially the same physical capacity.

10. A compound venturi structure as set forth in claim 2, wherein at least one of said venturis has a different physical capacity than another of said venturis.

11. A compound venturi structure as set forth in claim 3, wherein said venturis have essentially the same physical capacity.

12. A compound venturi structure as set forth in claim 3, wherein at least one of said venturis has a different physical capacity than another of said venturis.

13. A compound venturi structure as set forth in claim 1, wherein said material is a fluid.

14. A compound venturi structure as set forth in claim 1, wherein said material is a flowable solid.

15. A compound venturi structure as set forth in claim 1, comprising a central tube that extends through said collector along said axis.

16. A compound venturi structure as set forth in claim 15, wherein said structure includes a venturi connected at an upstream end of the central tube.

17. A compound venturi structure as set forth in claim 15, wherein said structure includes a multi-venturi cluster connected at an upstream end of the central tube.

18. A venturi structure as set forth in claim 1, wherein said venturi inlets are all in essentially the same plane.

19. A compound venturi structure including first and second venturi cluster arrangements, each of said arrangements comprising:

a venturi cluster including at least two venturis, each of said venturis having an inlet, a throat and an outlet, and each being arranged and adapted for causing the flow of an induced material by passing an inducing fluid therethrough, whereby respective mixtures of induced materials and inducing fluids are discharged from said outlets; and a collector having an inlet end that is connected to and arranged in fluid communication with the outlets of said venturis, whereby the respective mixtures of inducing fluids and induced materials discharged from said outlets are collected and intermixed to present a single mixed stream of said fluids and materials, the venturis of the first venturi cluster arrangement being spaced apart and the collector thereof being annular so as to provide a central space, said second cluster arrangement being disposed in said central space.

20. A burner assembly comprising:

a venturi cluster including at least two venturis, each said venturi having a main, elongated venturi body portion defining a conduit, a venturi inlet and a venturi outlet, each said venturi being arranged and adapted for inducing the flow of an induced fluid by passing an inducing fluid therethrough, whereby respective mixtures of induced and inducing fluids are discharged from said outlets;

an elongated collector adapted and arranged for receiving the respective mixtures of inducing and induced fluids discharged from said venturis, and collecting and intermixing said mixtures to present a single mixed stream of said fluids, said collector having an outer peripheral wall defining an internal mixing chamber, an inlet end, an outlet end and a central longitudinally extending axis extending between said ends, said main, elongated venturi body portions being disposed in essential parallelism relative to said central axis;

a respective elongated tubular segment for each venturi, said tubular segments being adapted and arranged to interconnect and intercommunicate the inlet end of the collector with said venturi outlets, each said tubular segment having an inlet connected to the outlet of a corresponding venturi and an outlet connected to the inlet end of the collector, and each segment being disposed to extend outwardly away from the inlet end of the collector at an angle relative to said central axis so that the inlet of the tubular segment as well as the inlet of the corresponding venturi are positioned at locations which are spaced radially from said central axis a greater distance than the distance from the axis to the place where the outlet of the tubular segment is connected to the collector; and a burner tip attached to and in fluid communication with an outlet end of said collector, said tip being arranged for receiving said single mixed stream of fluids from said collector and directing the same into a combustion zone.

21. A burner assembly as set forth in claim 20, wherein said venturi inlets are all in essentially the same plane.

22. A burner assembly as set forth in claim 20, wherein each said venturi is arranged and adapted for inducing a flow of air by receiving a gaseous fuel in its said inlet and allowing the gaseous fuel to pass through said conduit, creating an ultra fuel lean mixture of said air and said fuel, and discharging an ultra fuel lean mixture of air and fuel from its said outlet.

23. A burner assembly as set forth in claim 20, wherein at least one of said venturis is adapted and arranged for operation with a gaseous fuel as the inducing fluid.

24. A burner assembly as set forth in claim 23, wherein said at least one of said venturis is adapted and arranged for operation with air as the induced fluid, whereby said single mixed stream comprises a fluid fuel and air.

25. A burner assembly as set forth in claim 23, wherein said at least one of said venturis is adapted and arranged for operation with recirculated flue gas as the induced fluid, whereby said single mixed stream comprises a fluid fuel and recirculated flue gas.

26. A burner assembly as set forth in claim 24, wherein another of said venturis is adapted and arranged for operation with a gaseous fuel as the inducing fluid and with recirculated flue gas as the induced fluid, whereby said single mixed stream comprises a fluid fuel, air and recirculated flue gas.

27. A burner assembly as set forth in claim 23, wherein said at least one of said venturis is adapted and arranged for operation with a combustion inert diluent as the induced fluid, whereby said single mixed stream comprises a fluid fuel and said combustion inert diluent.

28. A burner assembly as set forth in claim 27, wherein said diluent is steam.

29. A burner assembly as set forth in claim 27, wherein said diluent is nitrogen.

30. A burner assembly as set forth in claim 20, wherein said venturis are each adapted and arranged to operate using a gaseous fuel as the inducing fluid and with air as the induced fluid, whereby said single mixed stream comprises a gaseous fuel and air.

31. A burner assembly as set forth in claim 20, wherein said inducing fluid is a gaseous fuel.

32. A burner assembly as set forth in claim 20, wherein said inducing fluid is a fuel oil.

33. A burner assembly as set forth in claim 20, wherein said induced fluid comprises air.

34. A burner assembly as set forth in claim 31, wherein said induced fluid comprises air.

* * * * *